US006757502B2

(12) United States Patent
Yoshikawa

(10) Patent No.: US 6,757,502 B2
(45) Date of Patent: Jun. 29, 2004

(54) IMAGE FORMING APPARATUS

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 728 days.

(21) Appl. No.: 09/764,261

(22) Filed: Jan. 19, 2001

(65) Prior Publication Data

US 2004/0086285 A1 May 6, 2004

(30) Foreign Application Priority Data

Jan. 20, 2000 (JP) ..... 2000-011947

(51) Int. Cl.[7] ..... G03G 15/16
(52) U.S. Cl. ..... 399/22; 399/13
(58) Field of Search ..... 399/21, 22, 122, 399/400, 13

(56) References Cited

U.S. PATENT DOCUMENTS 4,806,970 A * 2/1989 Nakatomi et al. ..... 399/122
4,937,622 A * 6/1990 Makiura ..... 399/21
5,012,281 A * 4/1991 Kusumoto et al. ..... 399/21
5,280,322 A * 1/1994 Kono ..... 399/22
5,402,211 A 3/1995 Yoshikawa
5,850,588 A 12/1998 Yoshikawa
6,160,974 A 12/2000 Yoshikawa et al.

FOREIGN PATENT DOCUMENTS

JP 6-122257 5/1994
JP 07140836 A * 6/1995 ..... G03G/15/20

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus of the present invention includes a paper sensor disposed in a fixing device downstream of a fixing roller pair in a direction of paper conveyance. When a jam occurs in the fixing device without the paper sensor sensing a paper sheet and if the fixing device is not pulled out of the apparatus body, it is determined that a paper left in the fixing device has not been removed. The apparatus is then inhibited from resuming its operation with a jam status being maintained.

8 Claims, 4 Drawing Sheets

IMAGE FORMING APPARATUS

BACKGROUND OF THE INVENTION

The present invention relates to a copier, printer, facsimile apparatus or similar image forming apparatus and more particularly to a measure against a jam in a fixing device included in an image forming apparatus.

Generally, an image forming apparatus includes a fixing device for fixing a toner image transferred to a paper sheet or similar recording medium by heating the toner image. To detect a jam likely to occur in the fixing device, a paper sensor may be positioned downstream of a heat roller, which is included in the fixing unit, in a direction in which the paper sheet is conveyed. When the paper sensor senses the leading edge of the paper sheet, it is determined that the paper sheet did not jam the fixing unit.

However, when a separator disposed in the fixing device for peeling off a paper sheet catches the paper sheet, the paper sensor does not sense the leading edge of the paper sheet. Further, the operator of the apparatus cannot easily see the inside of the fixing device, which is enclosed in a casing for heat insulation, or find a paper sheet left therein. The apparatus is therefore likely to resume its operation with a paper sheet remaining in the fixing device, causing a jam to be repeated.

Technologies relating to the present invention are disclosed in, e.g., Japanese Patent Laid-Open Publication No. 6-122257.

SUMMARY OF THE INVENTION

It is therefore an object of the present invention to provide an image forming apparatus capable of obviating a jam ascribable to a paper sheet left in a fixing device, but not sensed by a paper sensor.

It is another object of the present invention to provide an image forming apparatus facilitating even the removal of a paper sheet jamming a path extending over a fixing unit and a unit adjoining it.

In accordance with the present invention, an image forming apparatus capable of dealing with a recording medium jamming a fixing device includes a body to which the fixing device is removably mounted. The fixing device is pulled out of the body in the event of a jam occurred therein to thereby allow the jam to be removed. A fixing device sensor senses the fixing device when the fixing device is mounted to the body. A medium sensor is disposed in the fixing device for sensing a recording medium. When a jam occurs in the fixing device without the medium sensor sensing a recording medium, the apparatus is prevented from resuming its operation unless the set condition of the fixing device on the body being sensed by the fixing device sensor is interrupted.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
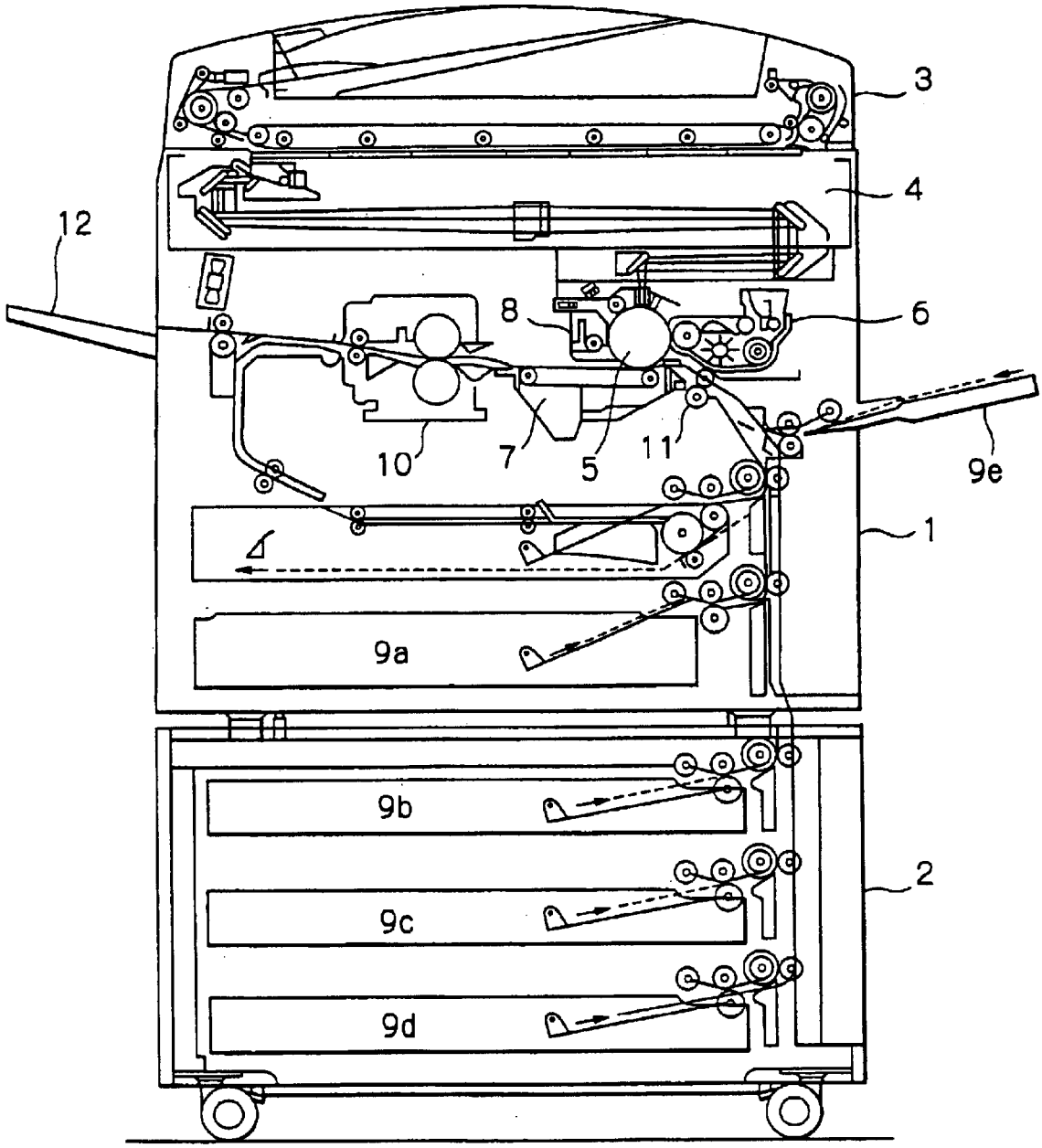
FIG. 1 is a section showing an image forming apparatus embodying the present invention.

Referring to FIG. 1 of the drawings, an image forming apparatus embodying the present invention is shown and implemented as a copier by way of example. As shown, the copier is generally made up of a body 1, a paper feed table 2, and an ADF (Automatic Document Feeder) 3.

A scanner 4 is disposed in the upper portion of the body 1. A photoconductive element 5 is positioned below the scanner 4 and implemented as a drum (drum 5 hereinafter). Various process units necessary for an electrophotographic process are arranged around the drum 5. The process units include a developing unit 6, an image transferring and conveying unit 7, and a cleaning unit 8. A fixing device 10 is positioned at the left-hand side of the image transferring and conveying unit 7, as viewed in FIG. 1.

A paper tray 9*a* is disposed in the copier body 1 while paper trays 9*b*, 9*c* and 9*d* are accommodated in the paper feed table 2 one above the other. The copier therefore has four paper trays in total. In addition, a manual feed tray 9*e* is mounted on one side of the body 1.

In operation, a drive mechanism, not shown, causes the drum 5 to rotate while a charger uniformly charges the surface of the drum 5. The scanner reads a document laid on a glass platen and outputs image data representative of the document image. The charged surface of the drum 5 is exposed imagewise in accordance with the image data. As a result, a latent image corresponding to the document image is electrostatically formed on the drum 5. The developing unit 6 develops the latent image with toner and thereby produces a corresponding toner image.

A paper sheet, which is a specific form of a recording medium, is fed from any one of the trays 9*a* through 9*e* to a registration roller 11. The registration roller 11 conveys the paper sheet to an image transfer position such that the leading edge of the paper sheet meets the leading edge of the toner image formed on the drum 5.

The image transferring and conveying unit 7 transfers the toner image from the drum 5 to the paper sheet reached the image transfer position. The paper sheet is then separated from the drum 5 and conveyed to the fixing device 10. After the fixing device 10 has fixed the toner image on the paper sheet, the paper sheet or copy is driven out to a tray 12. After the image transfer, the cleaning unit 8 cleans the surface of the drum 5 so as to prepare it for the next image formation.

Figure 2:
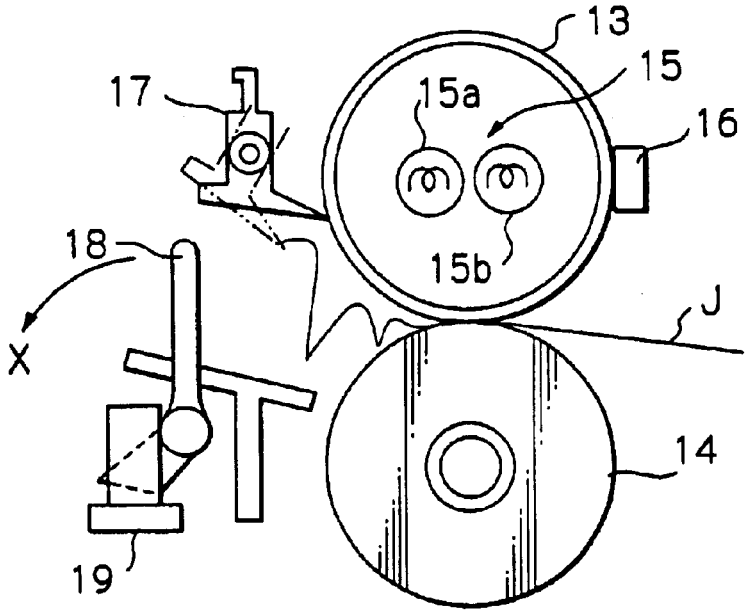
FIG. 2 is a sectional side elevation showing essential part of a fixing device included in the apparatus of FIG. 1.

FIG. 2 shows essential part of the fixing device 10. As shown, the fixing device 10 includes a heat roller 13 and a press roller 14 pressed against the heat roller 13 by a spring not shown. The heat roller 13 and press roller 14 constitute a fixing roller pair. Halogen lamps 15*a* and 15*b* are disposed in the heat roller 13 and constitute a heater 15 in combination. A thermistor or similar temperature sensor 16 is held in contact with the outer periphery of the heat roller 13 in order to sense the temperature of the heat roller 13. The heater 15 is controlled to generate heat in accordance with the output of the temperature sensor 16, heating the heat roller 13 to a preselected fixing temperature.

The paper sheet being conveyed by the image transferring and conveying unit 7 is brought to a nip between the heat roller 13 and the press roller 14. The heat roller 13 and press roller 14 fix the toner image on the paper sheet with heat and pressure while conveying the paper sheet to the left, as viewed in FIG. 2. After the fixation, a separator 17 peels off the paper sheet from the heat roller 13.

Further, a feeler 18 and a photointerrupter or similar sensor 19 responsive to the paper sheet are disposed in the fixing device 10. The feeler 18 and sensor 19 are a specific form of a paper sensor and may be replaced with any other suitable paper sensor. FIG. 2 shows a specific condition wherein the leading edge of the paper sheet, labeled J, has been caught by the separator 17 and jammed the fixing device 10. In this condition, the paper sensor consisting of the feeler 18 and sensor 19 does not sense the paper sheet. The sensor 19, however, outputs a jam signal because the paper sheet does not arrive thereat. In response, the operation of the copier is interrupted, so that the operator of the copier can deal with the jam.

In the condition shown in FIG. 2, a conventional copier resumes printing after a recovery procedure even if the jamming paper sheet J is not removed, because the paper sheet J is not sensed. This causes the jam to be repeated in the fixing device 10. The illustrative embodiment prevents a jam from being repeated due to the paper sheet J left in the fixing device 10.

Figure 3:
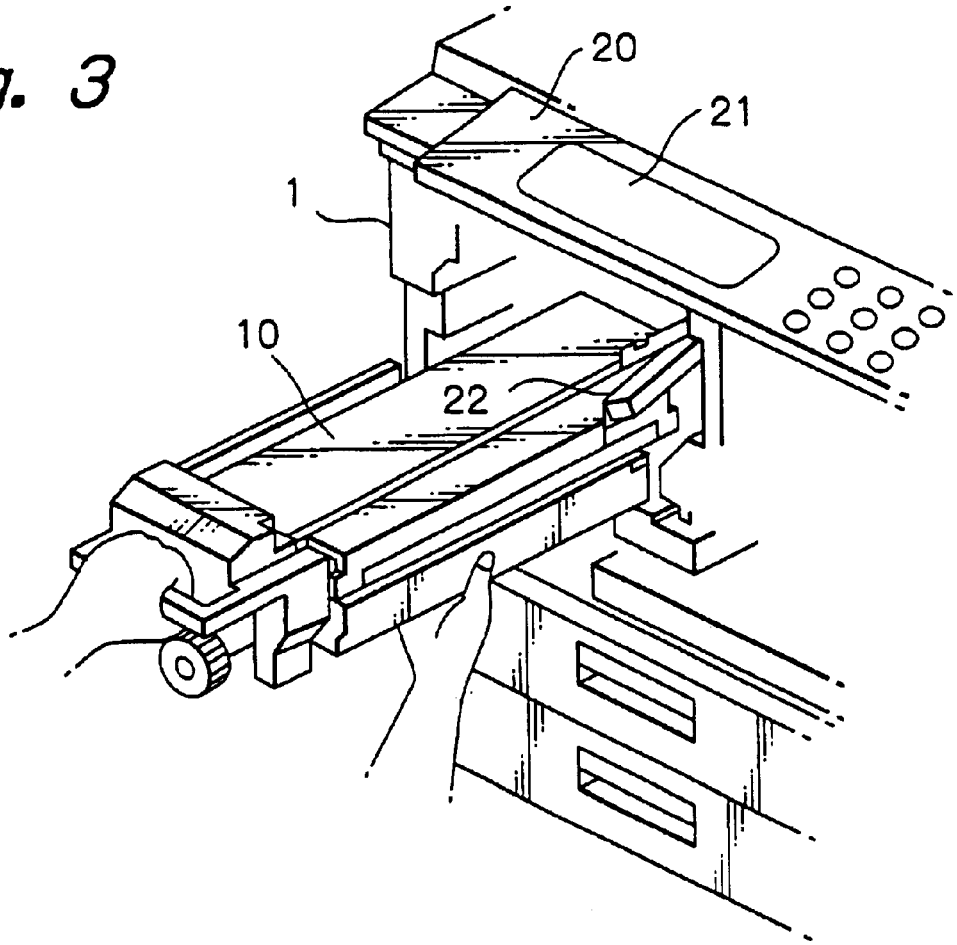
FIG. 3 is an isometric view demonstrating how the fixing device is pulled out of the body of the apparatus.

In the illustrative embodiment, the fixing device 10 is constructed into a unit removable from the copier body 1. Specifically, as shown in FIG. 3, the operator is capable of pulling the fixing device or unit 10 out of the copier body 1 by releasing a lock lever 22, which is mounted on the copier body 3. An operation panel 20 is mounted on the top front portion of the copier body 1 and includes a display 21.

Figure 4:
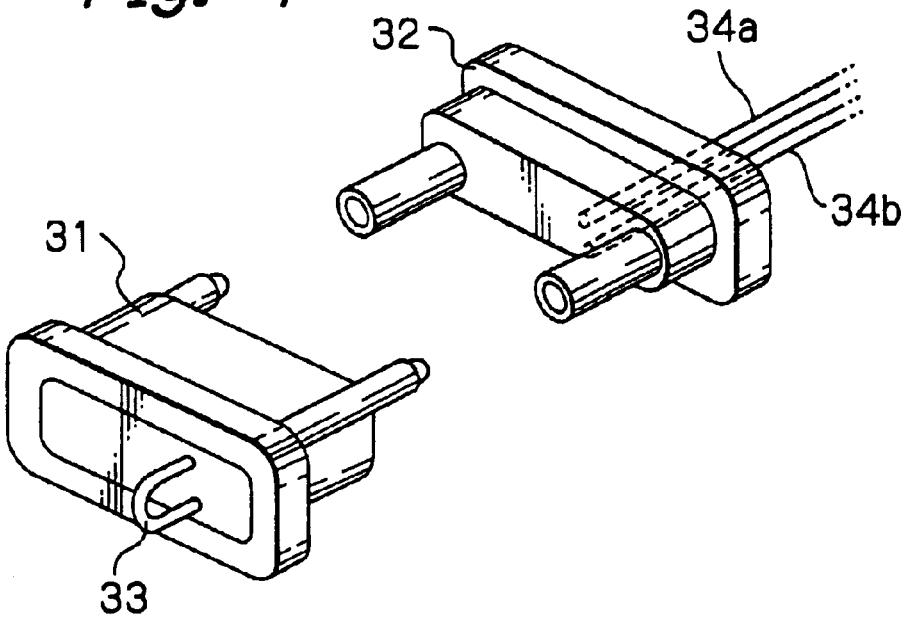
FIG. 4 is an isometric view showing a specific connector arrangement for connecting the fixing device and the body of the apparatus.

FIG. 4 shows a specific connector arrangement for connecting the fixing device 10 to the copier body 1. As shown, the connector arrangement is made up of connectors 31 and 32 mounted on the fixing device 10 and copier body 1, respectively. A generally U-shaped, conductive sensing member 33 is mounted on the connector 31 while sensing members 34*a* and 34*b* are mounted on the copier body 1. When the operator connects the connector 31 to the connector 32, i.e., when the operator mounts the fixing device 10 to the copier body 1, the sensing member 33 mates with the sensing members 34*a* and 34*b* at opposite ends thereof. As a result, electric conduction is set up between the sensing members 34*a* and 34*b*, indicating that the fixing device 10 has been set on the copier body 1.

Conversely, when the operator pulls the fixing device 10 out of the copier body 1, the sensing member 33 is released from the sensing members 34*a* and 34*b* and therefore electrically disconnects the sensing members 34*a* and 34*b*. This indicates that the fixing device 10 has been pulled out of the copier body 1. Let the mounting and dismounting of the fixing device 10 from the copier body 1 be referred to as a "set" condition and a "reset" condition, respectively.

Assume that the sensor made up of the feeler 18 and photointerrupter 19 and located downstream of the heat roller 13 and press roller 14 outputs a jam signal, i.e., the sensor does not sense a paper sheet at a preselected timing. Then, in the illustrative embodiment, the operation of the copier is interrupted. At this instant, if the reset condition mentioned above is not sensed, the copier is inhibited from resuming the operation with a jam status being maintained. Assume that the reset condition is sensed, and that the operator performs a preselected recovering operation, e.g., opens and then closes a cover mounted on the copier body 1. Then, the copier is allowed to resume its operation.

More specifically, assume that a jam occurs in the fixing device of a copier because of a paper sheet not arriving at a paper sensor located downstream of a fixing roller pair. In this condition, the paper sheet is left in the fixing device. If the copier stops operating in response to the output of the paper sensor and again starts operating at the end of a recovering operation, e.g., when the opening and closing of a cover is sensed, the paper sheet left in the fixing device again brings about a jam. By contrast, the illustrative embodiment inhibits the copier from resuming its operation unless the reset condition is sensed, while maintaining a jam status. This successfully prevents a jam from being repeated due to the above paper sheet.

As shown in FIG. 3, to remove a paper sheet jamming the fixing device 10, the operator is required to pull the fixing device 10 out of the copier body 1. At this instant, the reset condition is sensed. Therefore if the reset condition is sensed after the interruption of operation of the copier, it is determined that the paper sheet left in the fixing device 10 has been removed. If the reset condition is not sensed, it is determined that the paper sheet has not been removed; a jam status is maintained in order to prevent the jam from being repeated.

Figure 5:
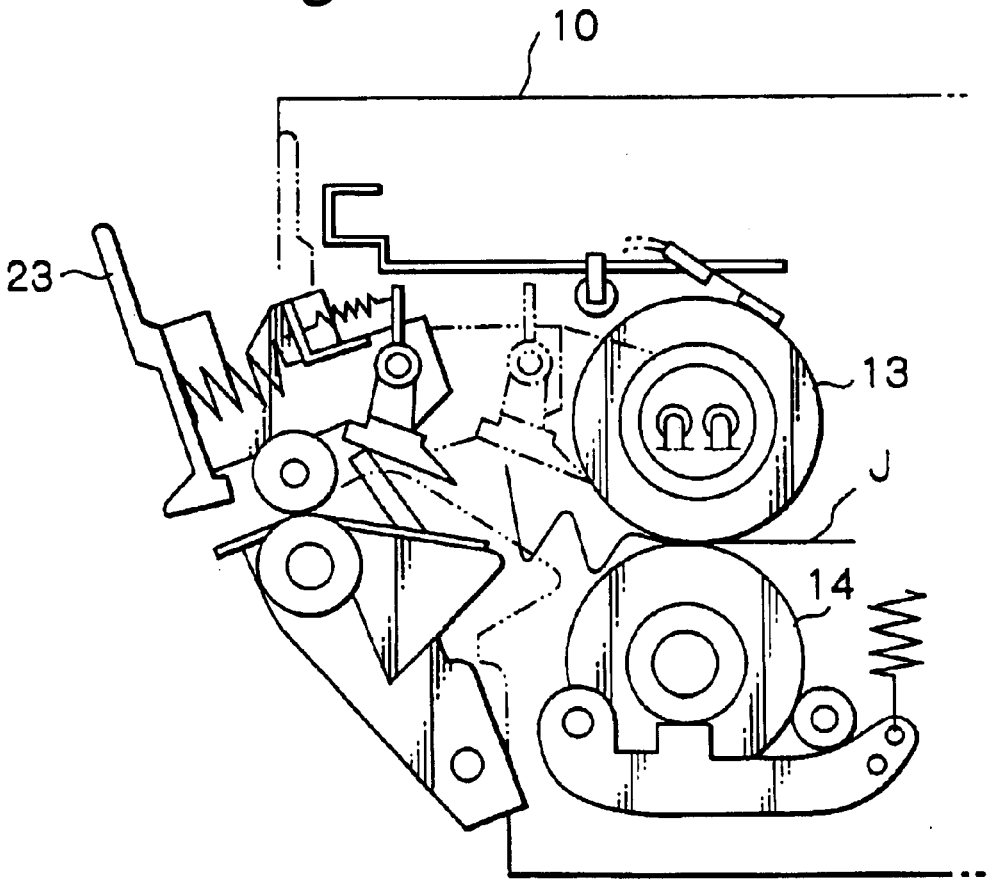
FIG. 5 is a fragmentary section showing a configuration that allows a paper sheet left in the fixing device to be removed.

In the illustrative embodiment, to remove the paper sheet jamming the fixing device 10, the operator is required to pull the device 10 out of the copier body 1 and then open a cover 23 (see FIG. 5) mounted on the device 10. Usually, at least 1 second is necessary for the operator to complete such an operation, which includes the removal of the paper sheet. In light of this, only if the reset condition is continuously sensed for 1 second or more, i.e., only if the fixing device 10 is pulled out of the copier body 1 over 1 second or more, the copier is allowed to resume its operation on the detection of the end of the operator's recovering operation. If the duration of the reset condition is less than 1 second, the copier is inhibited from resuming the operation with a jam status being maintained.

For example, assume that the operator pulls out the fixing device 10 only to such an extent that the connector 31 is released from the connector 32, and then returns it immediately in less than 1 minute. Then, the illustrative embodiment obviates a jam ascribable to the paper sheet that has not been removed from the fixing device 10. In addition, the period of time of 1 second or more assigned to the sensing of the reset condition is effective to avoid chattering. It is to be noted that the period of time of 1 second is only illustrative and may be replaced with, e.g., 1.5 seconds or 2 seconds so long as it is long enough to determine whether or not the operator has removed the jamming paper sheet.

Further, in the illustrative embodiment, a message, e.g., "Remove paper from the fixing device." appears on the display 21 of the operation panel 20, FIG. 3, in order to urge the operator to surely remove a jamming paper sheet in the event of a jam of the kind described. This more surely prevents the jam from being repeated due to the paper sheet left in the fixing device 10.

A paper sheet sometimes jams a path extending over the fixing device 10 and a unit adjoining it. For example, in FIG. 2, it is likely that the trailing edge portion of the paper sheet J exists in the image transferring and conveying unit 7, FIG. 1, upstream of the fixing device 10. In such a case, if the operator pulls the fixing device 10 out of the copier body 1, the paper sheet J is apt to tear and partly remain in the fixing device 10. The part of the paper sheet remaining in the fixing device 10 would again bring about a jam.

Figure 6:
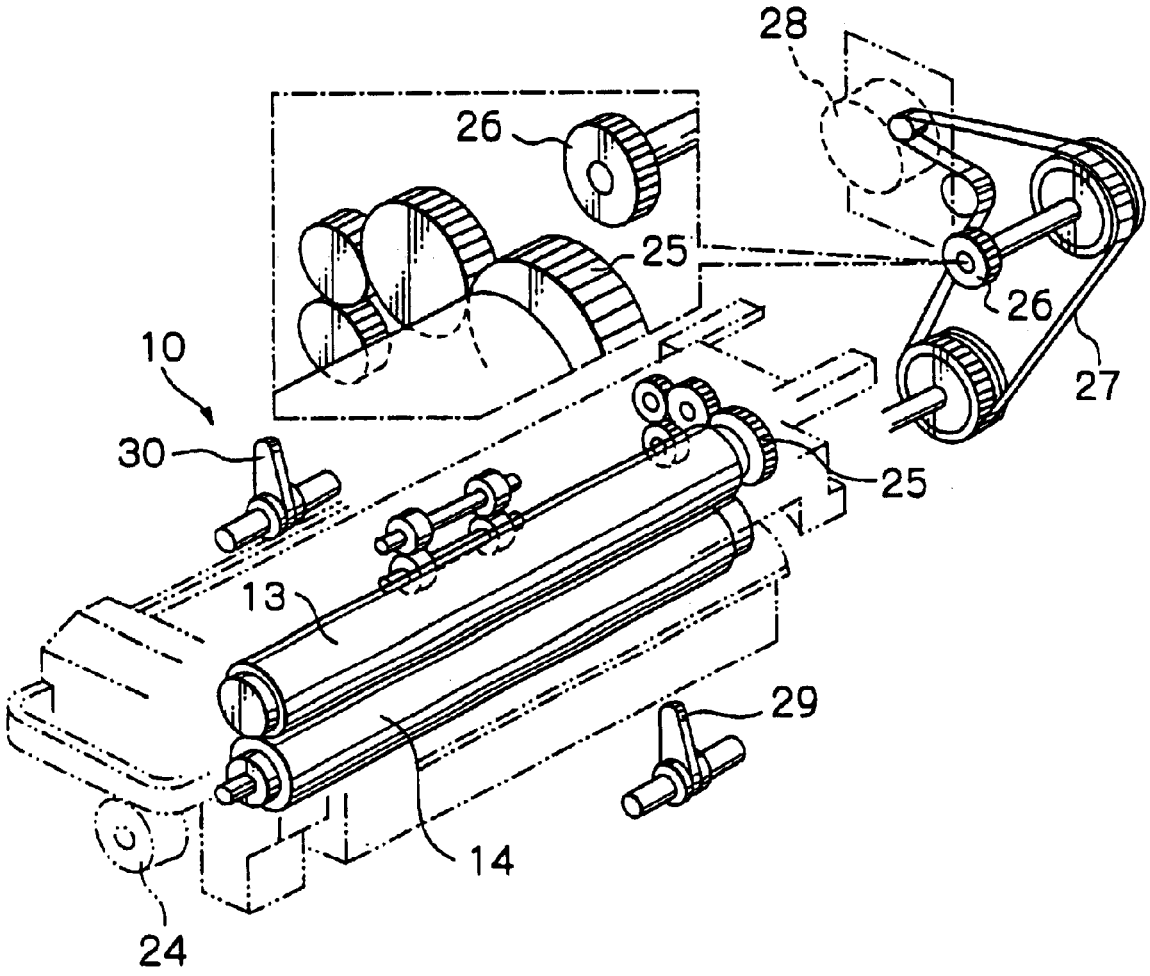
FIG. 6 is an isometric view showing a driveline for driving the fixing unit.

To solve the above problem, as shown in FIG. 6, the illustrative embodiment additionally includes paper sensors 29 and 30 respectively located upstream and downstream of the fixing device 10 in the direction of paper conveyance. When a jam in the fixing device 10 is sensed and if either one of the paper sensors 29 and 30 is sensing a paper sheet, a message for urging the operator to turn a knob 24, e.g., "Turn the knob of the fixing device." appears on the display 21. The knob 24 causes the press roller 14 to rotate when turned by hand. The press roller 14, in turn, rotates the heat roller 13 pressed against the press roller 14. The heat roller 13 causes a drive motor 28 to rotate via an input gear 25, a drive gear 26 held in mesh with the input gear 25, and a belt 27. Of course, when the operator pulls out the fixing device 10 and then turns the knob 24, the motor 28 does not rotate because the input gear 25 is released from the drive gear 26.

In the illustrative embodiment, the drive motor 28 is implemented by a DC motor. The rotation of the drive motor 28 is sensed via, e.g., an encoder not shown. This allows the rotation of the drive motor 28 to be sensed.

When the operator turns the knob 24, the entire paper sheet jamming the fixing device 10 is driven out of the device 10 to either one of an upstream and a downstream unit. This prevents the paper sheet from tearing when the fixing device 10 is pulled out and thereby facilitates the removal of the paper sheet. In addition, another jam ascribable to part of the paper sheet left in the fixing device 10 is obviated. The message "Turn the knob." appearing on the display 21 disappears when the rotation of the motor 28 is sensed as a result of the operator's manipulation of the knob 24.

While the illustrative embodiment has concentrated on a copier, the present invention is similarly applicable to any other image forming apparatus, e.g., a printer or a facsimile apparatus. The image forming section shown and described is only illustrative and may be replaced with a digital image forming section using a laser beam. This is also true with the image transfer section and fixing device. For example, the heat roller accommodating a heater, e.g., halogen lamps may be replaced with a self-heating heat roller using an induction heating system or a resistor.

In summary, it will be seen that the present invention provides an image forming apparatus capable of preventing a jam from being repeated due to a paper sheet left in a fixing device. Further, the apparatus of the present invention urges the operator of the apparatus to surely remove the paper sheet left in the fixing device. In addition, the apparatus urges the operator to remove the paper sheet before pulling out the fixing device, thereby preventing the paper sheet from tearing.

Various modifications will become possible for those skilled in the art after receiving the teachings of the present disclosure without departing from the scope thereof.

What is claimed is:

1. An image forming apparatus capable of dealing with a recording medium jamming a fixing device, said image forming apparatus comprising:

a body to which the fixing device is removably mounted, wherein said fixing device is pulled out of said body in the event of a jam occurred in said fixing device to thereby allow said jam to be removed;

fixing device sensing means for sensing the fixing device when said fixing device is mounted to said body; and first medium sensing means disposed in the fixing device for sensing a recording medium;

wherein when a jam occurs in the fixing device without said first medium sensing means sensing a recording medium, said image forming apparatus is prevented from resuming an operation unless a set condition of said fixing device on said body being sensed by said fixing device sensing means is interrupted.

2. An apparatus as claimed in claim 1, wherein said apparatus is allowed to resume the operation when the set condition of said fixing device is continuously interrupted for more than a preselected period of time.

3. An apparatus as claimed in claim 1, further comprising display means for displaying, in the event of the jam occurred without said first medium sensing means sensing a recording medium, a message informing an operator of said apparatus of the recording medium left in the fixing device.

4. An apparatus as claimed in claim 1, further comprising:

rotation sensing means responsive to a rotation of a drive motor that drives the fixing device; and second medium sensing means and third medium sensing means respectively located upstream and downstream of the fixing device in a direction of paper conveyance for sensing a recording medium;

wherein when either one of said second and third medium sensing means senses a recording medium in the event of a jam occurred in the fixing device and if said rotation sensing means does not sense a rotation of the drive motor, a message for urging an operator of said apparatus to remove a recording medium from an upstream side or a downstream side of said fixing device.

5. An image forming apparatus capable of dealing with a recording medium jamming a fixing device, said image forming apparatus comprising:

a body to which the fixing device is removably mounted, wherein said fixing device is configured to be pulled out of said body in the event of a jam occurred in said fixing device to thereby allow said jam to be removed;

a fixing device sensor configured to sense the fixing device when said fixing device is mounted to said body; and a first medium sensor disposed in the fixing device and configured to sense a recording medium;

wherein when a jam occurs in the fixing device without said first medium sensor sensing a recording medium, said image forming apparatus is prevented from resuming an operation unless a set condition of said fixing device on said body being sensed by said fixing device sensor is interrupted.

6. An apparatus as claimed in claim 5, wherein said apparatus is allowed to resume the operation when the set condition of said fixing device is continuously interrupted for more than a preselected period of time.

7. An apparatus as claimed in claim 5, further comprising a display configured to display, in the event of the jam occurred without said first medium sensor sensing a recording medium, a message informing an operator of said apparatus of the recording medium left in the fixing device.

8. An apparatus as claimed in claim 5, further comprising:

a rotation sensor configured to sense a rotation of a drive motor that drives the fixing device; and a second medium sensor and a third medium sensor respectively located upstream and downstream of the fixing device in a direction of paper conveyance and configured to sense a recording medium;

wherein when either one of said second and third medium sensors senses a recording medium in the event of a jam occurred in the fixing device and if said rotation sensor does not sense a rotation of the drive motor, a message for urging an operator of said apparatus to remove a recording medium from an upstream side or a downstream side of said fixing device.

* * * * *